US005525261A

United States Patent [19]

Incorvia et al.

[11] Patent Number: 5,525,261

[45] Date of Patent: Jun. 11, 1996

[54] ANTI-STATIC COMPOSITION AND METHOD OF MAKING THE SAME

[75] Inventors: Michael J. Incorvia, Lansdale; Stephen A. Fischer, Yardley, both of Pa.

[73] Assignee: Henkel Corporation, Plymouth Meeting, Pa.

[21] Appl. No.: 324,823

[22] Filed: Oct. 18, 1994

[51] Int. Cl.[6] ..... H05F 1/00; H05F 1/02

[52] U.S. Cl. ..... 252/500; 252/86; 252/88; 252/8.7; 252/8.75; 57/901; 427/393.1; 427/393.5; 427/430.1; 427/434.2; 427/289; 427/290; 427/412; 427/474.4; 427/475.5; 428/480; 428/423.1; 428/413; 564/281

[58] Field of Search ..... 252/8.6, 8.8, 500, 252/8.7, 8.75; 57/901; 524/910, 911; 428/289, 290, 412, 474.4, 475.5, 480, 423.1, 413; 427/393.1, 393.5, 430.1, 434.2; 564/281

[56] References Cited

U.S. PATENT DOCUMENTS

| | | | |
|---|---|---|---|
| 2,567,011 | 9/1951 | Diesslin et al. | 560/227 |
| 2,626,876 | 1/1953 | Carnes | 117/138.8 |
| 2,626,877 | 1/1953 | Carnes | 117/138.8 |
| 2,642,416 | 6/1955 | Ahlbrecht et al. | 526/245 |
| 2,734,830 | 2/1956 | Hagge et al. | 117/47 |
| 2,759,019 | 8/1956 | Brown et al. | 564/96 |
| 2,803,615 | 8/1957 | Ahlbrecht et al. | 524/805 |
| 2,856,420 | 10/1958 | Crawford | 560/227 |
| 2,897,170 | 7/1959 | Gruber | 524/245 |
| 2,934,450 | 4/1960 | Brown | 106/287 |
| 3,044,962 | 7/1962 | Brunt et al. | 252/110 |
| 3,095,373 | 6/1963 | Blomfield | 252/8.8 |
| 3,112,241 | 11/1963 | Mackenzie | 162/164 |
| 3,123,640 | 3/1964 | Longley | 564/285 |
| 3,125,641 | 5/1964 | Longley | 564/294 |
| 3,198,754 | 8/1965 | Ahlbrecht et al. | 528/367 |
| 3,207,730 | 9/1965 | Guenthner | 526/243 |
| 3,257,407 | 6/1966 | Brace | 546/346 |
| 3,350,218 | 10/1967 | Gagliardi | 117/76 |
| 3,468,697 | 9/1969 | Hunter | 117/66 |
| 3,503,890 | 3/1970 | Davisson et al. | 252/152 |
| 3,510,246 | 5/1970 | Keen et al. | 8/116.2 |
| 3,510,494 | 5/1970 | Gagliardi | 546/336 |
| 3,529,983 | 9/1970 | Vasta | 106/178 |
| 3,542,859 | 11/1970 | Litt et al. | 562/504 |
| 3,565,927 | 2/1971 | Wakeman et al. | 554/108 |
| 3,620,665 | 11/1971 | Lanner | 8/115.6 |
| 3,654,235 | 4/1972 | Crovatt et al. | 524/221 |
| 3,689,810 | 9/1972 | Walles | 317/258 |
| 3,723,512 | 3/1973 | Niederprum et al. | 562/113 |
| 3,850,642 | 11/1974 | Bailey et al. | 430/528 |
| 3,888,678 | 6/1975 | Bailey et al. | 430/528 |
| 3,931,080 | 1/1976 | Hammer et al. | 524/542 |
| 3,936,537 | 2/1976 | Baskerville et al. | 427/242 |
| 3,984,731 | 10/1976 | Martin | 317/2 R |
| 4,038,294 | 7/1977 | Conner et al. | 554/52 |
| 4,095,946 | 6/1978 | Jones et al. | 8/137 |
| 4,096,079 | 6/1978 | Pardee | 252/51.5 R |
| 4,113,630 | 9/1978 | Hagner et al. | 252/8.6 |
| 4,118,525 | 10/1978 | Jones | 427/242 |
| 4,139,477 | 2/1979 | Hayek et al. | 252/8.8 |
| 4,144,177 | 3/1979 | Minegishi et al. | 252/8.8 |
| 4,147,742 | 4/1979 | Castro et al. | 524/223 |
| 4,154,881 | 5/1979 | Hirakawa et al. | 428/92 |
| 4,169,279 | 9/1979 | Friedman et al. | 361/212 |
| 4,183,367 | 1/1980 | Goebel et al. | 132/7 |
| 4,183,981 | 1/1980 | Kunzel et al. | 427/242 |
| 4,237,155 | 12/1980 | Kardouche | 427/242 |
| 4,245,992 | 1/1981 | Yamashita et al. | 8/461 |
| 4,257,769 | 3/1981 | Kleber et al. | 8/188 |
| 4,263,157 | 4/1981 | Steiner et al. | 252/54.6 |
| 4,268,583 | 5/1981 | Hendy | 428/516 |
| 4,310,426 | 1/1982 | Smeltz | 252/8.8 |
| 4,313,978 | 2/1982 | Stevens et al. | 427/384 |
| 4,314,308 | 2/1982 | Faulkner | 361/212 |
| 4,339,391 | 7/1982 | Hoffman et al. | 554/91 |
| 4,346,130 | 8/1982 | Tropea | 427/393.1 |
| 4,368,127 | 1/1983 | Richmond | 252/8.8 |
| 4,409,109 | 10/1983 | Richmond | 252/8.8 |
| 4,497,716 | 2/1985 | Tai | 252/8.8 |
| 4,530,778 | 7/1985 | Nelson et al. | 252/500 |
| 4,612,150 | 9/1986 | De Howitt | 264/103 |
| 4,689,253 | 8/1987 | Rowe | 427/429 |
| 4,701,268 | 10/1987 | Nelson et al. | 252/8.8 |
| 4,743,266 | 5/1988 | Harper, Jr. | 8/181 |
| 4,774,029 | 9/1988 | Poulin | 562/598 |
| 4,804,483 | 2/1989 | O'Lenick, Jr. et al. | 252/8.8 |
| 4,806,260 | 2/1989 | Broze et al. | 252/8.8 |
| 4,820,511 | 4/1989 | Hoeffkes et al. | 424/70 |
| 4,885,102 | 12/1989 | Yamamura et al. | 252/8.8 |
| 4,889,643 | 12/1989 | Royce et al. | 252/8.8 |
| 4,891,143 | 1/1990 | Woodward et al. | 252/8.75 |
| 4,904,825 | 2/1990 | Govindan | 562/84 |
| 4,980,086 | 12/1990 | Hiraiwa et al. | 252/511 |
| 4,980,205 | 12/1990 | Haskell | 427/294 |
| 5,002,681 | 3/1991 | Wierenga et al. | 252/90 |
| 5,053,531 | 10/1991 | Govindan | 562/114 |
| 5,076,828 | 12/1991 | Taniuchi et al. | 71/86 |
| 5,112,528 | 5/1992 | Malone | 252/500 |
| 5,219,493 | 6/1993 | Seshadri | 252/500 |

*Primary Examiner*—Anthony Green

*Attorney, Agent, or Firm*—Ernest H. Szoke; Wayne C. Jaeschke; Real J. Gradmaison

[57] ABSTRACT

Antistatic agents and their use in natural or synthetic textiles or formed plastic substrates to enhance the surface resistivity thereof. The antistatic agent comprises a mixture of polyoxyalkylamine derivatives comprising a fluoro-acid moiety, a fatty acid moiety and a quaternary ammonium moiety. The coatings remain effective after exposure of the treated substrate to an aqueous environment and to elevated temperatures.

15 Claims, No Drawings

ANTI-STATIC COMPOSITION AND METHOD OF MAKING THE SAME

FIELD OF THE INVENTION

The present invention relates to antistatic agents and their use particularly in textile and plastics processing.

BACKGROUND OF THE INVENTION

Electrostatic charge is the result of electrification of an object such that the charge is confined to the object. Friction between two surfaces in close contact typically gives rise to electrostatic charge or static electricity.

Textiles and plastics generally have low conductivity and dissipate electrostatic charge at a relatively low rate. While it has been proposed to attenuate electrostatic charge build-up on textile and plastic materials by reducing its rate of generation, friction is inherent in many plastics and textile processing operations, particularly the latter, and cannot be substantially reduced. Consequently, increasing the rate of electrostatic charge dissipation of a textile or plastic material by increasing its electrical conductivity through the application of internal or external antistatic agents is commonly used as a means of controlling electrostatic charge build-up in such materials.

External or surface antistatic agents are directly applied as a coating to the surface layer of a textile or formed plastic substrate, typically dissolved or suspended in a suitable vehicle, such as water or another solvent. Internal antistatic agents are commonly used in formed plastic substrates and are physically mixed or blended with the resin mass prior to the forming operation, e.g., spinning, drawing, molding or the like, so as to be uniformly distributed throughout the body of the finished product, including the surface layer. Internal antistatic agents generally provide a longer lasting electrostatic charge dissipative effect.

Various chemicals have been proposed for use as antistatic agents, including, by way of example, long-chain amines, amides and quaternary ammonium salts; esters of fatty acids and their derivatives; sulfonic acids and alkyl aryl sulfonates; polyoxyethylene derivatives; polyglycols and their derivatives; polyhydric alcohols and their derivatives; and phosphoric acid derivatives.

Treatment of textile materials such as polyester and nylon fabrics with antistatic agents has been shown to reduce soiling. Static-prone plastic articles, such as packaging materials, that are treated with antistatic agents resist accumulation of dust and thus are more attractive for packaging of consumer products. Moreover, static charge is beneficially reduced in plastic packaging and other plastic products that have the potential to cause damage to semiconductor chips and that constitute a possible explosion hazard in areas where flammable gases are used.

Ideally, surface antistatic agents used in the processing of textile and plastic materials and the resulting products are stable and not transient. That is to say, an amount of antistatic agent sufficient to provide effective electrostatic charge dissipation is retained on the surface of the coated substrate, whether textile or plastic, through processing steps and finished product. Such processing often involves exposure of the treated textile or plastic to an aqueous environment, which tends to reduce the amount of antistatic agent present on the treated surface, thus diminishing its static electricity dissipative effect. The use of stable antistatic agents offers the advantage of obviating repeated application of the antistatic agent to the static electricity prone substrate.

Antistatic agents are also used for enhancing the receptivity of plastic surfaces to electrostatically applied coatings, e.g., in automobile production. See, for example, U.S. Pat. No. 5,219,493. In this application also, it is desirable that the antistatic agent resists removal when exposed to an aqueous rinse or wash liquid.

SUMMARY OF THE INVENTION

It is an object of the present invention to provide an antistatic composition capable of rapidly and effectively dissipating electrostatic charge from a static-prone object treated therewith.

It is a further object of this invention to provide an antistatic composition for internal or external application to textile and plastic substrates.

It is another object of this invention to provide an antistatic composition having desirable thermal stability which imparts a relatively long lasting electrostatic charge dissipative effect to substrates treated therewith.

It has been found that the above objects are obtained by means of the antistatic composition of the present invention which is formed as a reaction product comprising a mixture of N-acyl derivatives of a polyoxyalkylene polyamine and the polyoxyalkylene polyamine and N-acyl derivatives thereof wherein at least one reactive terminal nitrogen is quaternarized or substituted with a quaternary ammonium alkyl group. The alkyl moiety of the quaternary ammonium alkyl group has from three to ten carbon atoms and is unsubstituted or substituted with a hydroxyl group. The N-acyl groups of the N-acyl derivatives of the polyoxyalkylene polyamines comprise a combination of (i) at least one normal or branched, saturated or unsaturated fluoroaliphatic acyl group, substituted or unsubstituted fluorocycloaliphatic acyl group or substituted or unsubstituted fluoroaromatic acyl group in which the fluorinated acyl groups have from 2 to 25 carbon atoms and (ii) at least one normal or branched, saturated or unsaturated fatty acyl group which has from 6 to 36 carbon atoms.

The reaction mixture that results from preparation of the aforesaid composition is applicable, as is, for antistatic treatment of various substrates. The working composition thus contains very small amounts (<0.5%) of unreacted starting materials. Of course, one or more additional components, such as solvents, may be included in the composition, e.g., to assist in solubilizing the compound, or in drying of the composition on the treated substrate. It is an advantage of the composition of the invention that isolation and recovery of the antistatically active agent from the reaction mixture is obviated.

The present invention also provides a method for dissipating electrostatic charge on a static-prone substrate by causing the substrate to take up, either internally or on the surface thereof the composition of the invention in an amount effective to impart to the substrate a surface resistivity value in the range of from about $10^{13}$ ohms or less, or about 90% electrostatic charge decay time of about 20 seconds or less, or both.

Also in accordance with the present invention, there are provided articles of manufacture including textile, thermoplastic and thermoset substrates which are treated with the composition of the invention and effectively dissipate static electricity.

DETAILED DESCRIPTION OF THE INVENTION

As used herein, "antistatic agent" refers to a substance, or mixture of substances, taken up by a material, either internally or externally, to make the material more capable of dissipating static charge. The term "static-prone" refers to substrates that are susceptible to development of electrostatic charge, due to the way in which they are processed, or otherwise. The term "quaternarized" refers to a reaction in which sufficient chemical entities are attached to nitrogen to result in a positively charged nitrogen covalently bound to four substituents.

The antistatic composition of the invention is the product of a chemical reaction in which the reactants are (1) polyoxyalkylamines containing at least two amine functional groups, in which the polyether backbone contains ethylene oxide, propylene oxide or a mixture of ethylene oxide and propylene oxide and wherein the degree of alkyoxylation is between 8 to 200 moles ethylene oxide, propylene oxide or a mixture of ethylene oxide and propylene oxide, (2) an aliphatic, cycloaliphatic or aromatic fluoro-acid, (3) a fatty acid having a chain length between 6 and 40 carbon atoms and (4) a quaternarizing agent, such as dimethyl sulfate, diethyl sulfate and methyl chloride, or a quaternary ammonium alkylating agent such as dimethylaminoethyl acrylate dimethyl sulfate quaternary salt, 2,3-epoxypropyl trimethylammonium chloride or 3-chloro-2-hydroxypropyl trimethylammonium chloride. These agents convert reactive terminal nitrogens to quaternary ammonium groups or result in the substitution of quaternary ammonium alkyl groups on the terminal nitrogen.

Suitable polyoxyalkylene polyamines for use in forming the antistatic composition of the invention include those of the formula

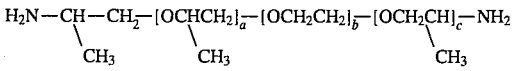

wherein (a +c) is preferably 2.5; b is in the range of 8 to 200; and the approximate molecular weight is from about 500 to about 10,000.

Examples of the preferred polyoxyalkylene polyamine are polyether diamines which are based on a predominantly polyethylene oxide backbone. Most preferred is a polyoxyalkylene polyamine of the above formula which is available from the Texaco Chemical company under the trademark JEFFAMINE® ED-2001.

Examples of the preferred fluoro-acids are $CF_3(CH_2)_xCO_2H$; and $CF_3(CF_2)_yCO_2H$, where x and y may be from 0 to 23. The most preferred fluoro-acid is trifluoroacetic acid.

Examples of the preferred fatty acids are fatty acids with carbon chain lengths of $C_6$ to $C_{36}$ which are linear, branched, cyclic or aromatic. The most preferred fatty acid is isostearic acid.

The most preferred quaternary ammonium alkylating agent is 2,3-epoxypropyl trimethylammonium chloride which is available from the DeGussa Company under the tradename QUAB® 151. 3-chloro-2-hydroxypropyl trimethylammonium chloride which is available from the DeGussa Company under the tradename QUAB® 188 can also be used as a quaternary ammonium alkylating agent.

The reaction mixture may suitably contain, based on 100 equivalent percent of polyalkylene polyamine, from about 5 to about 45 equivalent percent of fluroaliphatic acyl group, preferably from about 10 to about 20 equivalent percent of fluoroaliphatic acyl group; from about 5 to about 45 equivalent percent of fatty acyl group, preferably from about 30 to about 40 equivalent percent of fatty acyl group; and from about 10 to about 90 equivalent percent of quaternized nitrogen or quaternary ammonium alkyl group, preferably from about 40 to about 60 equivalent percent of quaternized nitrogen or quaternary ammonium alkyl group. For example, about 1.0 equivalent of polyalkylene polyamine may be reacted with 0.1 to 0.2 equivalent of fluoroaliphatic acyl group, 0.3 to 0.4 equivalent of fatty acyl group, and 0.4 to 0.6 equivalent of alkylating agent or quaternary ammonium alkyl group.

The antistatic compositions of the invention are prepared by known synthesis procedures, using conventional reaction conditions, as will be exemplified below. The progress of the reaction may be monitored, if desired, by standard analytical techniques, e.g., infra-red spectroscopy or by titrating the depletion of starting materials (acid).

Although the resulting reaction mixture can advantageously be applied, as is, to static-prone substrates, various additives may be included in the reaction mixture to impart certain desirable properties to the resultant composition. The selection of appropriate additives will depend to some extent on the manner in which the antistatic agent is to be taken up by the substrate. Additives may include solvents, e.g., isopropanol, surfactants such as ethoxylated nonylphenol (Trycol® 6974, available from Henkel Corporation), and the like. The appropriate amount of any specific additive to be included in the antistatic composition of the invention may readily be determined on the basis of routine testing.

The antistatic composition may be applied to natural or synthetic textile materials or mixtures of natural and synthetic materials, e.g., nylon, rayon, acetate, rayon-cellulosic materials such as cellulose acetate-proprionate, cellulose-butyrate, cotton, linen, jute, ramie, wool, mohair and glass, e.g., fiberglass and fiberglass insulation. The textile materials may take virtually any form, including individual fibers, yarns, woven materials such as fabrics, cloth, carpets, rugs and upholstery and non-woven materials such as felts, bats and mats. In the case of fiberglass strand or fiberglass insulation, the composition may be applied externally as a finish or as part of a sizing composition.

The plastic substrates which may be treated with, or in which the antistatic compositions of the invention may be incorporated include, for example, nylon (polyamide), polycarbonate, polyphenylene oxide, polyester, polyolefins and the like, and blends thereof with various other compatible resins.

Representative examples of suitable thermoplastic materials which may be treated using the antistatic composition of the invention include a polyester/polyether (Lomod®, Ashland Chemical Company), a nylon/polyester (Bexloy®, available from E. I. DuPont de Nemours) and a polyurethane (Bayflex®, available from Mobay Chemical). Commercial sheet molding compound, composed, for example, of a polyester filled with calcium carbonate and chopped glass fibers may also be treated with the antistatic composition described herein.

Examples of thermoset materials which may be treated with the antistatic composition of the invention include linear polyethylene, alkyl polyester and epoxy resins.

Procedures by which the antistatic composition is taken up by any given substrate will depend on the manner of manufacturing the substrate and may include surface application via padding, immersing, roller coating, spray coating and the like. The composition may also be blended with resinous materials which thereafter undergo various forming operations, e.g., extrusion or molding to yield the finished substrate. Of course, formed substrates may also be surface coated. For textile materials, the preferred form of application is by immersion, i.e., running the textile substrate through a bath of the antistatic composition. The appropriate mode of application may be selected by those skilled in the art in view of the overall dimensions or geometrical configuration of the surface to be treated. In any case, the mode of application should be one which causes a reasonably uniform thickness of the antistatic composition to be deposited on the treated surface. For flat surfaces, such as sheet or strip material, this may usually be accomplished most readily through the use of rollers or squeegees. The application temperature of the composition may vary over a wide range, but is preferably from 5° to 50° C.

Coating thickness may vary from as a little as a monolayer to any desired thickness, although generally no advantage is achieved by a thickness greater than about 20 microns, while the cost of the treatment is increased. Normally, the coating thickness for textile and thermoplastic or thermoset substrates to acquire an acceptable level of conductivity will be at least 0.2 microns. In operation, processing variables will normally be determined based upon the desired coating thickness to be obtained.

Any excess antistatic agent is typically removed from the treated substrate. The excess may be removed by a gentle water rinse, air knife blow drying, immersion in water (with or without agitation), air pressure or ultrasound. Drying may be carried out by, for example, circulating air, infra-red oven drying, or mechanical drying. While room temperature drying may be employed, it is preferable to use elevated temperatures to decrease the amount of drying time required.

Under normal operations, it is desirable to use elevated oven temperatures and warm air streams of velocity insufficient to disturb the wet film. From a practical standpoint, the drying temperature should be well below the softening point of the surface undergoing surface treatment.

Surfaces treated in accordance with the present invention are characterized by a surface resistivity of less than about $10^{13}$ ohms or about 90% electrostatic charge decay time of about 20 seconds or less, or both. Devices for measuring resistivity or electrostatic charge decay time are commercially available from various sources and their use is exemplified herein below.

Static or charge dissipation is a function of the surface resistivity property of the material. Surface resistivity is inversely related to the surface conductivity. In other words, the lower the value of surface resistivity, the better the ability of an applied charge to dissipate to ground. Surface resistivity testing is complementary to electrostatic charge decay measurement tests which measure the time required for an applied charge to dissipate to a predetermined cut-off value. In electrostatic charge decay testing, the lower the time required for dissipation of the applied charge, the higher the surface conductivity. Hence, low resistivity values will generally correlate with low electrostatic charge decay times.

The following examples are provided to describe the invention in further detail. These examples, which set forth the best mode presently contemplated for carrying out the invention, are intended to illustrate and not to limit the invention.

EXAMPLE I

Preparation of Antistatic Composition

An antistatic composition in accordance with this invention was prepared by reacting 106.0 grams of polyoxyalkylene polyamine (Jeffamine ED-2001, equivalent weight of 1099) and 1.7 grams of trifluoroacetic acid in a 0.25 liter round bottom reaction flask. A nitrogen sweep was started and the contents were heated to 175° C. while stirring. After four hours, 10.5 grams of isostearic acid (equivalent weight of 310.4) were added and the reaction temperature was raised to 200° C. and maintained until all the acid was consumed. An amount of 8.1 grams of 2,3-epoxypropyl trimethylammonium chloride (Aldrich Chemical Company, 90% active) was added at 50° C. and was reacted at 100° to 160° C. until the epoxide content in the reaction mass was determined to be zero. Then 40 grams of deionized water were added to adjust the solids to 71% and three grams of 85% phosphoric acid were added to adjust the pH to 6.2.

The reaction was followed using acid-base titration to monitor the consumption of acid.

EXAMPLE II

Surface Treatment of Nylon 6,6 Fabric and Determination of Static Decay Time Fabric composed of nylon 6,6 [supplied by E. I. Du Pont de Nemours, Inc., Wilmington, Del.] was used to determine the static dissipative effect of a composition of the invention.

The antistatic composition used in this example was prepared according to the procedure described in Example I, above.

To prepare the nylon 6,6 fabric for the initial static decay time measurement, the fabric was scoured by immersing for 15 minutes in isopropanol, squeezing dry by hand, and drying for 5 minutes at 300° F. The scoured fabric was treated with one of the following solutions: (1) 6% (w/w) aqueous solution (Solution 1) of the antistatic composition of Example I, (2) 6% (w/w) aqueous solution (Solution 2) of the product of the reaction of 300 grams of ethyl bis(polyethoxyethanol) tallow ethyl sulfate ammonium salt and 102 grams of trifluoroacetic acid in the presence of a toluene solvent, and (3) 6% (w/w) aqueous solution (Solution 3) of the product of the reaction of 100 grams of ethyl bis(polyethoxyethanol) tallow ethyl sulfate ammonium salt and 10.3 grams of trifluoroacetic acid in the presence of a toluene solvent. The fabrics were treated by immersing the fabric in the treatment solutions for 2 minutes, squeezing dry by hand, immersing in deionized water for 2 minutes, squeezing dry by hand, and drying for 10 minutes at 300° F. After oven-drying, the treated fabrics were stored in a 50% relative humidity cabinet for 24 hours. The static charge decay times were determined for the treated fabrics after the 24 hour storage period, as were the pick-up weights, i.e., the amount of antistatic agent that adhered to the fabrics during the treatment. The static charge decay times and pick-up weights are given in Table I. I. The treated fabrics were then subjected to an additional washing step in which they were immersed in deionized water for 15 seconds, squeezed dry and stored in the 50% relative humidity cabinet for 24 hours. After the additional washing step, the static decay times were determined again.

Conductivity of the treated fabric was measured by electrostatic charge decay at a specified relative humidity using an electrostatic charge decay meter (Model 406C, Electro-Tech Systems, Inc., Glenside, Pa.) according to the following procedure. A five KV charge (either positive or negative) was applied to the fabric then the charge was allowed to dissipate to a prescribed percentage of the initial charge (in this case 90% charge dissipation). The time in seconds required for decay of the charge to the specified level was measured initially and after washing the fabric. Conductivity of the treated fabric is inversely proportional to the time required for the prescribed electrostatic decay to occur.

The results of electrostatic charge decay measurements on the treated fabric are set forth in the following table.

TABLE I

| Solution | Pick-Up Weights | Static Decay Time (seconds) (Initial) | (Washed) |
|---|---|---|---|
| Solution 1 | 0.54% | 5.94 | 20.37 |
| Solution 2 | 1.1% | 5.75 | 34.38 |
| Solution 3 | 0.67% | 5.00 | 33.63 |

The test results set forth in Table I indicate that the fabric treated with the antistatic composition of the invention (solution 1) exhibit similar initial electrostatic charge decay as compared with the other agents tested. However, after washing, the fabric treated with the antistatic composition of the invention exhibits superior electrostatic charge decay as compared with the other agents tested. The short decay time of 20.37 seconds measured for washed nylon 6,6 fabric treated with the antistatic composition of the invention indicates that treatment with the antistatic composition of the invention imparts improved dissipation of static charge.

EXAMPLE III

Surface Treatment of Nylon 6,6 Yarn and Determination of Resistivity

Yarn composed of Nylon 6,6 was used to determine the static dissipative effect of a composition of the invention, measured in terms of surface resistance.

Finish-free Nylon 6,6 yarn was treated with the same treating solutions used in Example II, above. The treating solutions were applied to the yarn by a syringe pump. The protocol for making resistivity measurements was analogous to that described in "Resistivity and Static Behavior of Textile Surfaces" by S. P. Hersh in *Surface Characteristics of Fibers and Textiles*, Part 1, ed. by M. J. Schick; Marcel Dekker, Inc. (1975).

The surface resistivity values, which were measured after equilibration at the stated relative humidity values, are set forth in Table II as the logarithm of the surface resistivity. The abbreviation % FOY indicates the amount of finish on the yarn and the abbreviation % AOY indicates the amount of antistatic agent on the yarn. In the cases where % AOY is less than % FOY, it should be noted that the finish contains other components such as lubricants in addition to the antistatic agent.

TABLE II

| Antistat | % FOY | % AOY | $R_{surface}$ RH 10% | RH 47% | RH 58% |
|---|---|---|---|---|---|
| None | 0 | 0 | 14.6 | 14.2 | 13.7 |
| Solution 1 | 0.3 | 0.21 | 13.3 | 12.6 | 12.4 |
| Solution 1 | 0.1 | 0.07 | 13.6 | 13.2 | 13.0 |
| Solution 1 | 0.05 | 0.04 | 14.7 | 14.0 | 13.5 |
| Solution 2 | 0.3 | 0.3 | 10.6 | 10.2 | 9.9 |
| Solution 2 | 0.1 | 0.1 | 13.4 | 12.9 | 12.7 |
| Solution 2 | 0.05 | 0.05 | 13.2 | 13.6 | 13.2 |

TABLE II-continued

| Antistat | % FOY | % AOY | $R_{surface}$ RH 10% | RH 47% | RH 58% |
|---|---|---|---|---|---|
| Solution 3 | 0.3 | 0.3 | 10.8 | 10.4 | 10.3 |
| Solution 3 | 0.1 | 0.1 | 11.7 | 11.3 | 11.2 |
| Solution 3 | 0.05 | 0.05 | 13.5 | 13.2 | 13.0 |

The surface resistivity data set forth in Table II refer to the base ten logarithm of the surface resistance for the treated yarn. These data show that the surface resistivity of the antistatic composition of the invention is comparable to the surface resistance obtained by the antistatic agents Solution 2 and Solution 3. The results of this test show that the lowest surface resistivity value of the nylon 6,6 yarn (12.4) was measured at a relative humidity of 58%.

EXAMPLE IV

External Application of Antistatic Composition to Nylon 6,6 Panels and Determination of Resistivity 4"×6" panels composed of Nylon 6,6 [supplied by Advanced Coating Technologies, Inc., Hillsdale, Mich.] were used to determine the static dissipative effect of the antistatic composition of the invention, measured in terms of surface resistivity.

The antistatic composition used in this example was prepared according to the procedure described in Example I, above.

Each of three nylon 6,6 test panels was separately treated with (1) the antistatic composition of the invention, (2) antistatic composition of Example II, solution 3 without solvent according to the following test procedure. The nylon 6,6 panels were initially rinsed with deionized water and wiped with isopropanol. The treated panels were heated to 120° F. for 10 minutes and any excess antistatic agent was wiped from the panels with Kimwipe® tissue until no visible traces of the agent remained. The wiped panels were rinsed by immersing in a deionized water bath for 10 seconds, then dried at 120° C. for 10 minutes. The treated panels were stored in a humidity controlled cabinet at 45% relative humidity.

Each set of panels was measured for surface resistivity at the specified relative humidity using a Milli-to-2 Dr. Thiedig Wide Range Resistance Meter with an Electro-Tech Systems, Inc., Model 803A, surface/volume resistivity probe. The resistivity values, which were measured five hours after treatment and twenty-four hours after treatment are set forth in the following table.

TABLE III

| Antistatic Agent | Surface Resistance (ohms/square) 5 hours | 24 hours |
|---|---|---|
| Antistatic Composition of Example II, solution 1 without solvent | $5 \times 10^{11}$ | $8 \times 10^{11}$ |
| Antistatic composition of Example II, solution 3 without solvent | $1 \times 10^{11}$ | $2 \times 10^{11}$ |

The data in Table III show that the surface resistance values for the antistatic composition of the invention are in the same range as the surface resistance values for the comparative antistatic composition of Example II, solution 3.

EXAMPLE V

Determination of Thermal Stability

An aqueous solution of the antistatic agent of Example 1, above, was tested to determine its thermal stability, based on thermogravimetric analysis. A 71% (w/w) aqueous solution of the antistatic composition of Example I in deionized water was subjected to thermogravimetric analysis using a Perkin-Elmer 7 Series Thermal Analysis System. The percent weight remaining was recorded while the temperature was scanned at a rate of 10° C. per minute. The percent weight remaining measured at various temperatures are set forth in Table IV.

TABLE IV

| Temp. (°C.) | (Wt. %) | Temp. (°C.) | Weight (Wt. %) | Temp. (°C.) | Weight (Wt. %) |
|---|---|---|---|---|---|
| 30.00 | 9.4760e+01 | 105.00 | 7.6434e+01 | 180.00 | 7.5861e+01 |
| 35.00 | 9.3649e+01 | 110.00 | 7.6318e+01 | 185.00 | 7.5788e+01 |
| 40.00 | 9.2330e+01 | 115.00 | 7.6244e+01 | 190.00 | 7.5705e+01 |
| 45.00 | 9.0823e+01 | 120.00 | 7.6201e+01 | 195.00 | 7.5617e+01 |
| 50.00 | 8.8950e+01 | 125.00 | 7.6174e+01 | 200.00 | 7.5518e+01 |
| 55.00 | 8.6474e+01 | 130.00 | 7.6156e+01 | 205.00 | 7.5412e+01 |
| 60.00 | 8.3754e+01 | 135.00 | 7.6145e+01 | 210.00 | 7.5298e+01 |
| 65.00 | 8.1392a+01 | 140.00 | 7.6127e+01 | 215.00 | 7.5163e+01 |
| 70.00 | 8.0126e+01 | 145.00 | 7.6125e+01 | | |
| 75.00 | 7.9233e+01 | 150.00 | 7.6107e+01 | | |
| 80.00 | 7.8453e+01 | 155.00 | 7.6088e+01 | | |
| 85.00 | 7.7840e+01 | 160.00 | 7.6060e+01 | | |
| 90.00 | 7.7330e+01 | 165.00 | 7.6027e+01 | | |
| 95.00 | 7.6927e+01 | 170.00 | 7.5984e+01 | | |
| 100.00 | 7.6628e+01 | 175.00 | 7.5925e+01 | | |

The data in Table IV show the weight percent remaining due to vaporization loss of solvent water at low temperatures and a very gradual decrease in weight at temperatures above 100° C. The weight loss appears to be completed at temperatures around 100° C. The relatively small weight loss over the range of 100°–200° C. demonstrates the thermal stability of the antistatic agent of the invention.

While it is apparent that the various embodiments of the invention disclosed and exemplified are well suited to fulfill the above-stated objects, it will be appreciated that the invention is susceptible to modifications, variations and change without departing from the spirit of the invention, the full scope of which is delineated by the appended claims.

What is claimed is:

1. An antistatic composition comprising a reaction product formed by reacting (1) polyoxyalkylene polyamine having at least two amine functional groups and a polyether backbone containing ethylene oxide, propylene oxide or a mixture of ethylene oxide and propylene, an aliphatic, cycloaliphatic or aromatic fluoro-acid, (3) a fatty acid having a chain length between 6 and 40 carbon atoms, and (4) a quaternizing agent selected from the group consisting of dimethyl sulfate, diethyl sulfate, methyl chloride, a quaternary ammonium alkylating agent, and mixtures thereof.

2. A composition as claimed in claim 1 wherein said polyoxyalkylene polyamine is a polyether diamine having a backbone containing predominantly ethylene oxide, said fluoro-acid is trifluoroacetic acid, said fatty acid is isostearic acid, and said quaternary ammonium alkylating agent is 2,3-epoxypropyl trimethylammonium chloride.

3. A method for dissipating an electrostatic charge on a static-prone substrate comprising contacting said substrate selected from the group consisting of a textile substrate, a formed, thermoplastic substrate and a formed, thermoset substrate with an antistatic composition as claimed in claim 1 in an amount effective to impart to said substrate a surface resistivity value less than about $10^{13}$ ohms, or about 90% electrostatic charge decay time of about 20 seconds or less, or both.

4. A method as claimed in claim 3, wherein said antistatic composition is applied to the surface of said substrate.

5. A method as claimed in claim 3, wherein said antistatic composition is applied to the surface of natural and synthetic substrates.

6. A method as claimed in claim 4, wherein said antistatic composition is applied to said surface by passing said substrate through a bath comprising said antistatic agent.

7. A method as claimed in claim 4, wherein said antistatic composition is applied by passing substrates selected from the group consisting of thermoplastic and thermoset substrates through a bath comprising said antistatic agent.

8. A method for dissipating an electrostatic charge on a static-prone substrate comprising blending an antistatic composition as claimed in claim 1 with a resin mass prior to forming the substrate, said substrate being selected from the group consisting of a textile substrate, a thermoplastic substrate and a thermoset substrate, said antistatic composition being present in an amount effective to impart to said substrate a surface resistivity value less than about $10^{13}$ ohms, or about 90% electrostatic charge decay time of about 20 seconds or less, or both.

9. A method as claimed in claim 8, wherein said substrate is a textile substrate.

10. A method as claimed in claim 8, wherein said substrate is a formed, thermoplastic substrate.

11. An article of manufacture comprising a substrate selected from the group consisting of a textile substrate, a formed, thermoplastic substrate and a formed, thermoset substrate wherein said substrate is coated with the antistatic composition of claim 1.

12. An article of manufacture comprising a substrate selected from the group consisting of a textile substrate, a formed, thermoplastic substrate and a formed, thermoset substrate wherein said substrate is coated with the antistatic composition of claim 2.

13. An anti-static composition comprising a reaction product of: (i) a polyether polyamine of the formula

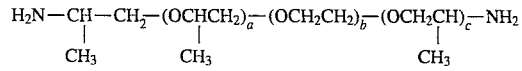

wherein b ranges from about 8 to about 200 and a+c is about 2.5, said polyether polyamine having a molecular weight in the range of about 500 to about 10,000; (ii) trifluoroacetic acid; (iii) isostearic acid and (iv) 2,3 epoxypropyl trimethylammonium chloride.

14. The composition according to claim 13 prepared by reacting about one equivalent of reactive component (i) with about 0.15 equivalent of reactive component (ii) and subsequently reacting the product with 0.35 equivalent of reactive component (iii), and further reacting the product with about 0.5 equivalent of reactive component (iv) to yield said composition.

15. An article of manufacture comprising a substrate selected from the group consisting of a textile substrate, a formed, thermoplastic substrate and a formed, thermoset substrate wherein said substrate is coated with the antistatic composition of claim 13.

* * * * *

UNITED STATES PATENT AND TRADEMARK OFFICE

CERTIFICATE OF CORRECTION

PATENT NO. : 5,525,261

DATED : Jun. 11, 1996

INVENTOR(S) : Michael J. Incorvia; Stephen A. Fischer

It is certified that error appears in the above-indentified patent and that said Letters Patent is hereby corrected as shown below:

Column 9:

In claim 1, line 5, after "and propylene", insert --oxide, (2)--.

Signed and Sealed this

Eighth Day of October, 1996

Bruce Lehman

*Attest:*

BRUCE LEHMAN

*Attesting Officer*

*Commissioner of Patents and Trademarks*